US010006199B2

(12) United States Patent
Underkofler et al.

(10) Patent No.: US 10,006,199 B2
(45) Date of Patent: Jun. 26, 2018

(54) TRIM STRIP SYSTEM FOR USE WITH UNDERHUNG CEILING PANELS

(71) Applicant: USG Interiors, LLC, Chicago, IL (US)

(72) Inventors: Abraham M. Underkofler, Kenosha, WI (US); Peder J. Gulbrandsen, Aurora, IL (US); Mark R. Paulsen, Waukegan, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days. days.

(21) Appl. No.: 15/822,362

(22) Filed: Nov. 27, 2017

(65) Prior Publication Data

US 2018/0073247 A1 Mar. 15, 2018

Related U.S. Application Data

(63) Continuation of application No. 15/000,060, filed on Jan. 19, 2016, now Pat. No. 9,920,524.

(51) Int. Cl.
*E04B 9/22* (2006.01)
*E04B 9/04* (2006.01)

(52) U.S. Cl.
CPC ..... *E04B 9/225* (2013.01); *E04B 9/04* (2013.01)

(58) Field of Classification Search
CPC ... E04B 9/225; E04B 9/04; E04B 9/10; E04B 9/127; E04B 9/30; E04B 9/068; E04B 9/122; E04B 9/064; E04B 9/067; E04B 9/08; E04B 9/18; E04B 9/26
See application file for complete search history.

(56) References Cited

U.S. PATENT DOCUMENTS

| | | | | |
|---|---|---|---|---|
| 2,099,211 | A | 11/1937 | Lucius | |
| 2,161,708 | A | 6/1939 | Heerwagen | |
| 2,399,785 | A | 5/1946 | Blickensderfer | |
| 2,648,102 | A | 8/1953 | Jacobson | |
| 2,946,414 | A | 7/1960 | Gordon | |
| 3,284,977 | A | 11/1966 | Lickliter | |
| 3,294,428 | A * | 12/1966 | Lickliter | E04B 9/067 403/52 |
| 3,590,546 | A | 7/1971 | Lambert | |
| 3,798,865 | A | 3/1974 | Curtis | |
| 4,335,973 | A | 6/1982 | Beck | |
| 4,438,613 | A | 3/1984 | Hintsa | |
| 4,531,340 | A | 7/1985 | Sauer | |
| 4,580,386 | A * | 4/1986 | Hemphill | E04B 9/064 403/346 |
| 4,642,957 | A | 2/1987 | Edwards | |
| 4,760,677 | A | 8/1988 | Nassof | |

(Continued)

*Primary Examiner* — James M Ference
(74) *Attorney, Agent, or Firm* — Pearne & Gordon LLP

(57) ABSTRACT

In combination, extruded aluminum trim strips joined end-to-end and a splice plate, the trim strips together, the trim strip cross-sections including a web and a pair of opposed angles, the angles and web forming a track for receiving a mid-section of the splice plate with a close sliding fit, the splice plate having lever tabs at opposite ends, notches at sides of the plate, the plate being disposed in the tracks of both lengths of trim strips, the lever tabs and associated edges of the lever tabs formed by the notches being outside of the tracks, the associated edge being arranged in a locking manner with outer surfaces of the angles as a result of the lever tabs being bent in place towards the web.

7 Claims, 3 Drawing Sheets

(56) References Cited

U.S. PATENT DOCUMENTS

| | | | | |
|---|---|---|---|---|
| 4,850,172 | A | 7/1989 | Gailey | |
| 5,024,034 | A | 6/1991 | Gailey | |
| 5,154,031 | A | 10/1992 | Wall | |
| 5,195,289 | A | 3/1993 | LaLonde | |
| 5,246,901 | A | 9/1993 | Sanderson | |
| 5,309,686 | A | 5/1994 | Underwood | |
| 5,313,759 | A | 5/1994 | Chase, III | |
| 5,350,227 | A | 9/1994 | Katz | |
| 5,359,817 | A | 11/1994 | Fulton | |
| 5,426,901 | A * | 6/1995 | Indracek | E04F 19/0436 52/288.1 |
| 5,428,930 | A | 7/1995 | Bagley | |
| 5,572,844 | A | 11/1996 | Stackenwalt | |
| 5,732,747 | A | 3/1998 | Holiday | |
| 5,740,642 | A | 4/1998 | Koenig, Jr. | |
| 5,813,179 | A | 9/1998 | Koenig, Jr. | |
| 5,937,605 | A | 8/1999 | Wendt | |
| 6,018,923 | A | 2/2000 | Wendt | |
| 6,138,425 | A | 10/2000 | Wendt | |
| 6,141,926 | A | 11/2000 | Rossiter | |
| 6,213,679 | B1 | 4/2001 | Frobosilo | |
| 6,305,139 | B1 | 10/2001 | Sauer | |
| 6,729,100 | B2 | 5/2004 | Koski | |
| 7,721,400 | B2 | 5/2010 | Parent | |
| 7,788,872 | B2 | 9/2010 | Platt | |
| 7,841,149 | B2 | 11/2010 | Jahn | |
| 7,886,496 | B1 | 2/2011 | Spransy | |
| 8,316,607 | B2 | 11/2012 | Eisner | |
| 8,381,486 | B1 | 2/2013 | Lehane, Jr. | |
| 8,522,498 | B2 | 9/2013 | Picken | |
| 8,534,016 | B2 | 9/2013 | DePaul | |
| 8,869,484 | B2 | 10/2014 | Gulbrandsen | |
| D733,934 | S | 7/2015 | Underkofler | |
| 9,187,898 | B1 | 11/2015 | Underkofler | |
| 9,464,433 | B1 | 10/2016 | Hulka | |
| 2003/0177735 | A1 | 9/2003 | Seeba | |
| 2005/0034412 | A1 | 2/2005 | Auriemma | |
| 2005/0160696 | A1 | 7/2005 | Kelly | |
| 2006/0102883 | A1 * | 5/2006 | Troutman | E01F 15/0438 256/13.1 |
| 2006/0218871 | A1 | 10/2006 | Wendt | |
| 2006/0260246 | A1 | 11/2006 | LaLonde | |
| 2007/0175152 | A1 | 8/2007 | Kupec | |
| 2009/0293403 | A1 | 12/2009 | Cedrone | |
| 2010/0139189 | A1 | 6/2010 | LaLonde | |
| 2010/0269444 | A1 | 10/2010 | Gulbrandsen | |
| 2011/0146194 | A1 | 6/2011 | Tedesco | |
| 2011/0252736 | A1 | 10/2011 | Bailey | |
| 2011/0283634 | A1 | 11/2011 | Underkofler | |
| 2012/0304574 | A1 | 12/2012 | Gulbrandsen | |
| 2013/0061550 | A1 | 3/2013 | Underkofler | |
| 2013/0167465 | A1 | 7/2013 | Santeramo | |
| 2013/0227907 | A1 | 9/2013 | Gulbrandsen | |
| 2013/0227908 | A1 | 9/2013 | Gulbrandsen | |
| 2013/0239493 | A1 | 9/2013 | Knight | |
| 2013/0318905 | A1 | 12/2013 | Underkofler | |
| 2014/0000205 | A1 | 1/2014 | Underkofler | |
| 2015/0040494 | A1 | 2/2015 | Lehane, Jr. | |
| 2015/0345139 | A1 | 12/2015 | Underkofler | |

* cited by examiner

TRIM STRIP SYSTEM FOR USE WITH UNDERHUNG CEILING PANELS

This application is a continuation of application Ser. No. 15/000,060, filed Jan. 19, 2016.

BACKGROUND OF THE INVENTION

The invention relates to accessories for edge trimming pan-shaped downwardly accessible suspended ceiling panels.

PRIOR ART

A category of ceiling panels are of a type hung below a suspended grid. Panels of this style are typically attached to the grid with torsion springs carried on the panels. The torsion springs draw the panels up against a lower face of the grid elements. This type of panel allows for downward accessibility into the plenum above the ceiling and can be arranged to conceal the grid and provide a monolithic appearance for the ceiling.

There exists a need for componentry for trimming or finishing the edges of the described panels where the edges are exposed such as where the ceiling is interrupted for lighting or other utilities.

SUMMARY OF THE INVENTION

The invention provides a trim strip having a unique configuration enabling it to be attached to a grid member and to conceal both the grid member and an edge of an adjacent pan-shaped underhung ceiling panel. The trim strip is proportioned to match the depth of the ceiling panels so that it is visually integrated with the ceiling panels. The disclosed trim strip is arranged to receive a unique splice plate that can be conveniently used for both miter joints and butt joints. The splice plate is received in a track on the inside face of the trim strip. Locking tabs on the splice plate are deployed, typically without tools, to tightly lock the splice plate to joined ends of two lengths of the trim strip. The locking elements of the splice plate are arranged to bear against areas remote from the material directly behind the strip faces so that the risk of distorting a face with a locking force is eliminated.

DESCRIPTION OF THE PREFERRED EMBODIMENT

Figure 1:
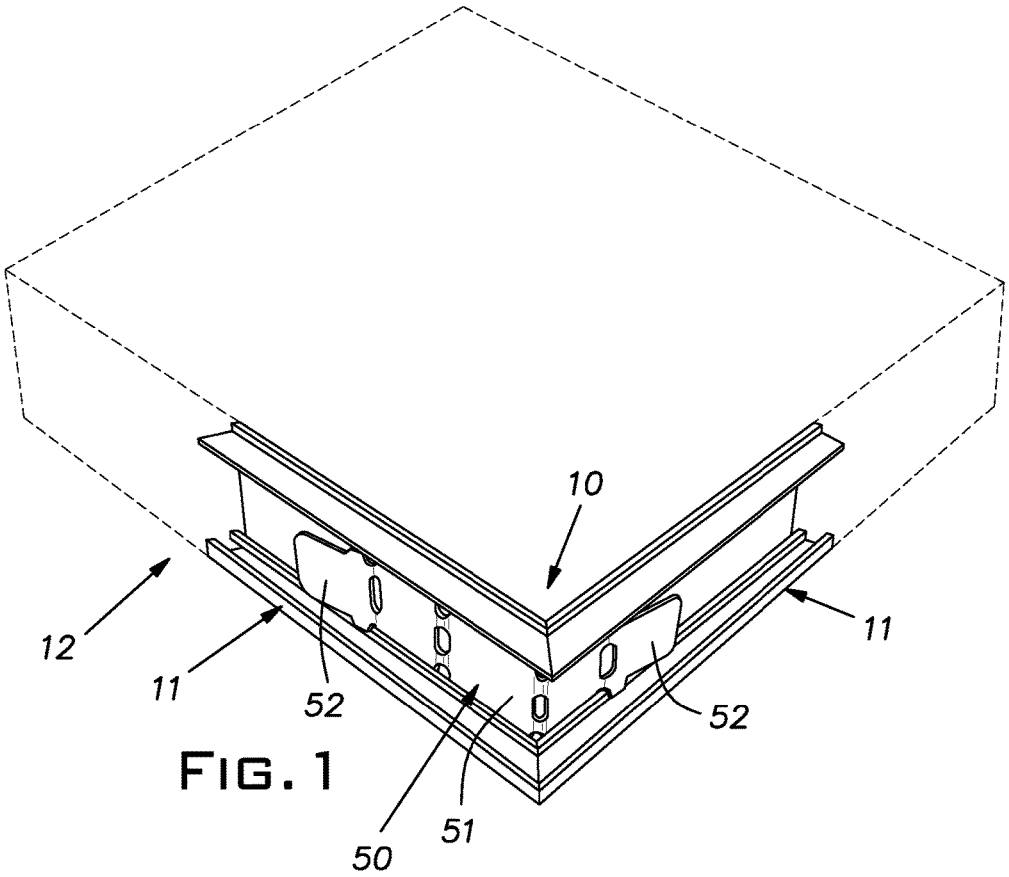
FIG. 1 is a fragmentary perspective view of a corner of a perimeter frame embodying the invention for a light fixture or other utility opening in a suspended ceiling constructed of a trim strip of the invention.

FIG. 1 illustrates an outer view of an "inside" miter joint 10 of two lengths of the inventive trim strip 11. The broken lines illustrated in FIG. 1 show a rectangular form fabricated of four lengths of the trim strip 11 in a rectangular frame 12. The illustrated frame 12 has the rectangular shape of a square that has nominal 2 foot by 2 foot dimensions of a conventional suspended ceiling grid module. The frame 12 can be assembled in other standard nominal rectangular sizes such as 2 foot by 4 foot. Dimensions used herein may be replaced by industry metric equivalents.

Different versions of a trim strip 11 and 13 are disclosed. Herein, the term "trim strip" relates to both versions 11 and 13 unless the context indicates otherwise.

The trim strip is preferably formed as an elongated unitary or one piece aluminum extrusion and may be painted or powder coated with a white or other desired color on its visible surfaces. The trim strip has the general shape of a channel with upper and lower horizontal flanges 16, 17, respectively, jointed by a vertical web 18. An extension 19 of the web 18 extends somewhat above the upper flange 16. Each trim strip 11, 13 is nominally 1-⅝ inch tall. A top surface 21 of the horizontal flange 16 is 1-½ inch above a lower surface 22 of the lower horizontal flange 17. The trim strip 13 of FIG. 4 has a horizontal extension 26 of the lower horizontal flange 17 on the side of the web 18 opposite the side on which the main part of the flange exists.

The lower flange 17 has a vertical lip 27 at its distal edge. The trim strip includes a pair of mutually facing angles 28, 29 integral with the web 18. The angles 28, 29 include a horizontal leg 31, 32 and a distal vertical leg 33, 34. The vertical spacing between the horizontal legs 31, 32 and the spacing of the vertical legs 33, 34 from the web 18 is maintained with sufficient accuracy such that collectively they form a track 36 in which is received a splice plate, discussed below, with a close sliding fit. Preferably, the elements of the trim strip have a uniform wall thickness except for the upper flange 16 which is made thinner to facilitate reception of a self-drilling screw as discussed below.

Figure 3:
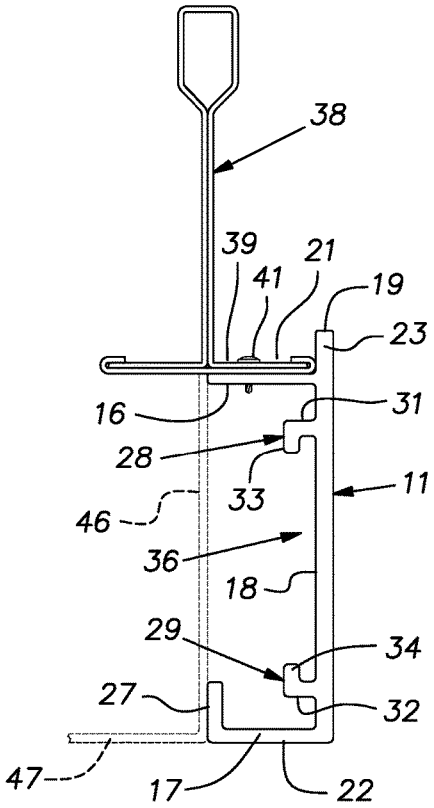
FIG. 3 is an end view of one form of the trim strip of the invention installed on a grid member and visually finishing the edge of a pan-shaped ceiling panel shown in phantom.
Figure 4:
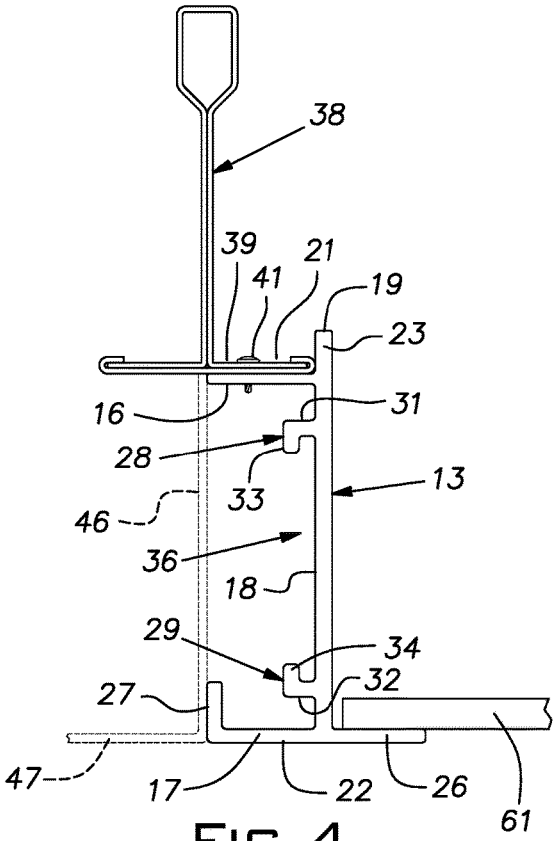
FIG. 4 is an end view of another form of the trim strip of the invention installed on a grid member and visually finishing the edge of a pan-shaped ceiling panel shown in phantom.

FIGS. 3 and 4 illustrate a typical mounting of a trim strip 11, 12 on a grid member 38. The image of the grid member 38 represents a standard grid tee or grid runner typically in the form of a main runner and special cross runners having slotted lower flanges for reception of torsion springs as is known in the industry and illustrated, for example, in U.S. Pat. No. 9,228,347. A trim strip is mounted on a grid member 38 by abutting the upper surface 21 of the upper flange 16 against the lower face of a flange 39 of the grid runner 38 and the upper extension 19 of the web 18 against a distal edge of the grid member flange 39. A series of short self-drilling screws (only one is shown in FIGS. 3 and 4) spaced along the length of the trim strip are driven downwardly through the grid member flange 39 and the trim strip upper flange 16 to fix the trim strip to the grid runner 38.

A principle use of the trim strip is to finish the edge of a pan-shaped metal ceiling panel 46, shown in phantom in FIGS. 3 and 4, where the panel edge would be otherwise exposed. This situation will occur, for example, where an adjoining panel is omitted to leave an opening for a light fixture or other utility such as an air supply or return vent or an audio speaker.

It will be understood, as suggested in FIGS. 3 and 4, the trim strip 11 or 13 will occupy one-half the width of the grid runner flange 39 while the periphery of a ceiling panel will occupy the other half. Note that the trim strips are proportioned so that when installed, their lower faces 22 are coplanar with a main face 47 of the adjacent ceiling panel 46.

Where a full module space in a suspension grid is devoted to a light fixture or other utility device, the trim strip 11 or 13 is fabricated into a rectangular frame dimensioned so that the upper part or extension 23 of the web of each trim strip side fits closely with the grid flanges 39 at the inner periphery of the module. To accomplish this, the lengths of the trim strip are cut at 45 degrees to produce miter joints such as shown in FIG. 1. Upper flanges 16 of the assembled lengths of the trim strip are raised up against the lower surface of the flanges 39 of the grid members 38 defining the module. The rectangular frame 12 is then fixed in place preferably with self-tapping screws 41 down through the grid flanges 39 into the upper flanges 16 or with equivalent fastening elements.

Figure 9:
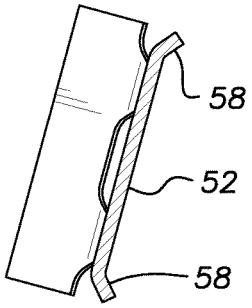
FIG. 9 is a sectional view of a lever tab of the splice plate taken in the plane 9-9 indicated in FIG. 7.
Figure 6:
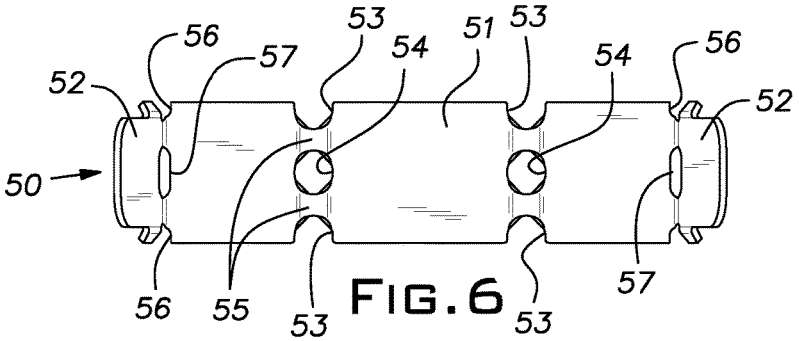
FIG. 6 is a plan view of the splice plate.

FIGS. 5-9 illustrate a metal splice plate 50 preferably formed as a one-piece sheet steel stamping of, for example, 0.047 inch hot dipped galvanized stock. The illustrated splice plate 50 is an elongated element having a flat rectangular mid-section 51 and inclined lever tabs 52 at each end. The mid-section 51 is weakened across two transverse lines by edge notches 53 and a hole 54 to form potential hinge lines for bending the splice plate 50 into a 90 degree angle. The splice plate 50 is embossed across land areas 55 between the notches 53 and hole 54 in the direction the lever tabs 52 are displaced before being deployed. A weakened hinge line is similarly provided at the juncture between the mid-section 51 and each lever tab 52 by edge notches 56 and a central slot 57. The lever tabs include laterally outlying grips 58 adjacent the mid-section 51. Lower edges 59 of the grips at the edge notches 53 are maintained relatively sharp during the stamping process to facilitate their "bite" onto a trim strip as discussed below. To augment the biting or gripping action of the tab edges 59, the grips 58 are stamped slightly downwardly out of the plane of the lever tab proper as shown in FIG. 9.

Figure 5:
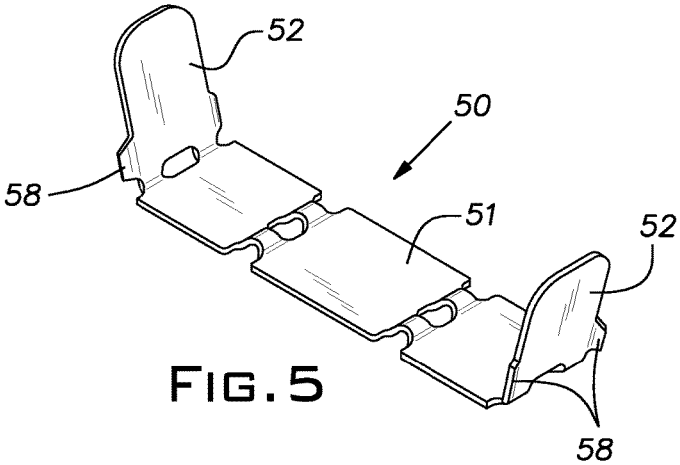
FIG. 5 is a perspective view of a trim strip splice plate of the invention.
Figure 7:
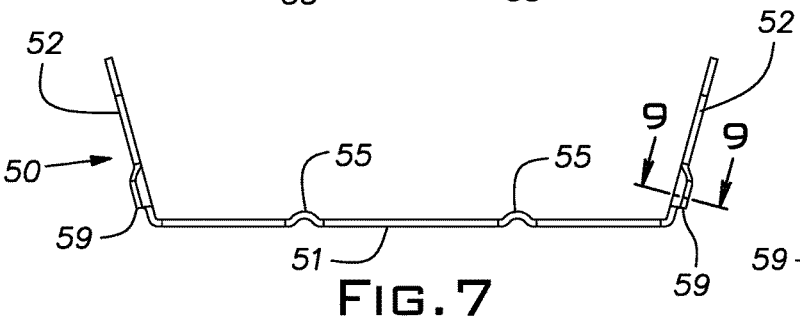
FIG. 7 is a side view of the splice plate.
Figure 8:
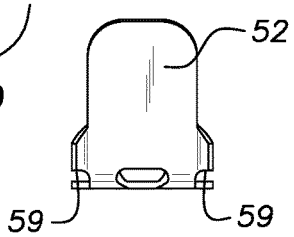
FIG. 8 is an end view of the splice plate.

The splice plate 50 is used to make miter and butt joints between lengths of the trim strips 11, 13. FIG. 1 illustrates the splice plate 50 holding joined lengths of trim strip abutted in an "inside" corner construction. Use of the term "inside" is in a traditional sense where the visible sides of the webs 18 are facing generally towards one another. The thickness and width of the plate mid-section 51 is proportioned to provide a close sliding fit within the track 36 established by the angles 28, 29. With the splice plate 50 bent into a right angle at one of the lines of the edge notches 53 and hole 54, each end of the mid-section 51 is inserted in a respective track 36 of one of the two lengths of trim strip to be joined at a corner. Initially, the lower edges 59 of the lever tab notches 56 are displaced from the plane of the top of the mid-section 51 a distance greater than the wall thickness of the vertical legs 33, 34 of the trim strip track 36. This spacing of the edges 59 allows the lever tab grips 58 to pass freely along outer surfaces of the vertical legs 33, 34. The initial orientation of the lever tabs 52 is shown in FIGS. 5 and 7.

The lever tabs 52 are deployed to lock the splice plate 50 and an associated trim strip length. As a lever tab 52 is depressed towards the web 18 of the respective trim strip length, the sharp edges 59 of the grips 58 bite into and lock onto respective track legs 33, the material of a trim strip preferably being softer than that of the splice plate 50. The material of the splice plate 50 is sufficiently malleable that a lever tab 52 does not appreciably spring back towards its original incline position.

The embossed area 55 where the splice plate 50 is hinged, avoids an interference of this hinge area with the ends of the trim strips at their webs 18 at a frame corner. With four splice plates 50 installed at the four corners, the frame 12 is a rigid assembly.

Figure 2:
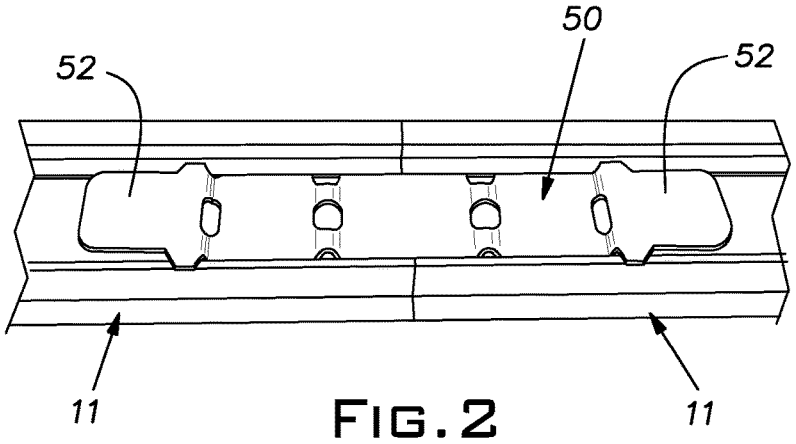
FIG. 2 is a side perspective view of a butt joint between two spliced trim strip lengths embodying the invention.

The trim strips 11 or 13 can be used to form the edges of several adjacent ceiling panels such as in narrow utility channel systems. More than one full length of trim strip may be needed to span the collective length of the panel edges. In such a case, two trim strips can be spliced by the disclosed splice plate 50. In this situation, shown in FIG. 2, the splice plate mid-section remains flat and is centered over the abutted ends of the lengths of trim strips. The splice plate 50 is locked in place on the two ends of the trim strips in the same manner as described in connection with the miter joint shown in FIG. 1. Specifically, the lever tabs 52 are pressed towards respective trim strip webs 18 to cause the edges 59 to lock on the track angle legs 33.

It will be appreciated that the locking forces developed by the lever tab grips 58 is supplied to parts of the trim strip that are remote from the exposed or finished face of the trim strip so that there is no risk that this locking force will cause a visible distortion in the visible face.

The version of the trim strip 13 shown in FIG. 4 is useful where it is desired that a ceiling opening such as for a light or air duct have a semi-flush membrane of, for example, transparent or translucent material, or a grill. In such a case, the membrane 61 can be installed on top of the horizontal extension 26. In a square opening, the horizontal extension 26 will extend on four sides of the opening. In a narrow utility channel, the horizontal extension can be arranged on both sides of the channel to support opposite edges of the membrane 61.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A combination of a trim strip and a splice plate comprising two lengths of an extruded aluminum trim strip joined end-to-end and a splice plate having a sheet metal body securing the trim strip lengths together, the trim strip lengths having identical cross-sections including a web and a pair of opposed angles, the angles and web forming a C-shaped track for receiving a mid-section of the splice plate with a close sliding fit, the splice plate having a length and a width, the length being greater than the width, and lever tabs at opposite ends of the mid-section bendable at respective hinge lines perpendicular to the length of the plate, notches at sides of the body at junctures of the mid-section and lever tabs, the mid-section being disposed in the tracks of each of the two lengths of the trim strip, the lever tabs and associated edges of the lever tabs formed by the notches being outside of the tracks at least at locations adjacent the junctures, the associated edges being arranged in a locking manner with outer surfaces of the angles as a result of the lever tabs being bent in place towards the web along respective lines perpendicular to a longitudinal direction of the strip.

2. The combination as set forth in claim 1, wherein the web has a vertical height greater than 1-½ inch whereby the web is adapted to cover an edge of a 1-½ inch pan-shaped ceiling tile located under a grid runner when the web is indexed against a side of the grid runner.

3. An elongated trim strip for use with pan-shaped, below grid suspended ceiling panels comprising an extruded aluminum body, the body having a channel configuration with a pair of horizontal flanges integral with and extending in a same direction from a vertical web, a pair of spaced opposed track forming projections integral with and projecting directly from the web and spaced from and located between the flanges, the flanges and projections extending along a length of the body, each projection forming a slot open towards the other projection whereby the slots are constructed and arranged to receive a splice plate, a lower one of said flanges having a vertical lip extending upwardly from the lower flange at a distal edge of the flange remote from the web, each of the flanges extending horizontally a distance substantially beyond a distance one of said projections projects horizontally.

4. The trim strip as set forth in claim 3, wherein an upper one of said flanges is thinner than the web and the lower one of said flanges to facilitate reception of a self-drilling screw.

5. The trim strip as set forth in claim 4, wherein the projections have a wall thickness equal to a wall thickness of the web.

6. The trim strip as set forth in claim 3, wherein said projections are right angles in cross-section and are formed by horizontal and vertical legs.

7. The trim strip as set forth in claim 3, wherein the web extends above an upper one of said horizontal flanges and is adapted to abut a side of a grid member when the upper one of said flanges is abutted with an underside of the grid member.

* * * * *